US005810133A

United States Patent [19]

Bigler

[11] Patent Number: 5,810,133

[45] Date of Patent: Sep. 22, 1998

[54] GARMENT BAG CONSTRUCTION INCLUDING REMOVABLE TRIANGULAR CONTAINERS

[76] Inventor: Gregory Bigler, 1896 N. 1100 E. Rd., Sheridan, Ind. 46069

[21] Appl. No.: 845,087

[22] Filed: Apr. 21, 1997

[51] Int. Cl.[6] ..... A45C 5/12; A45C 13/26

[52] U.S. Cl. ..... 190/110; 190/127; 206/278; 206/280

[58] Field of Search ..... 190/111, 113, 190/127, 110, 109; 206/278, 279, 287, 287.1, 280

[56] References Cited

U.S. PATENT DOCUMENTS

| | | | |
|---|---|---|---|
| 2,565,969 | 8/1951 | Judson | 206/278 X |
| 3,175,658 | 3/1965 | Bierman | 190/111 X |
| 3,448,839 | 6/1969 | Lugash | 206/287 |
| 3,647,035 | 3/1972 | Honig | 190/113 X |
| 3,831,740 | 8/1974 | Pendergast et al. | 206/287 X |
| 3,869,034 | 3/1975 | Thornton, Jr. | 190/111 X |
| 4,693,345 | 9/1987 | Mittelmann | 206/279 X |
| 4,693,368 | 9/1987 | King et al. | 206/287.1 |
| 4,736,839 | 4/1988 | King | 206/289 X |
| 4,753,342 | 6/1988 | Pulichino, Jr. et al. | 206/279 X |
| 5,054,589 | 10/1991 | Bomes et al. | 190/111 X |
| 5,060,795 | 10/1991 | Bomes et al. | 206/279 |

*Primary Examiner*—Sue A. Weaver
*Attorney, Agent, or Firm*—Daniel O'Connor

[57] ABSTRACT

An garment bag structure incorporates corner brace elements adapted to receive smaller containers for improved packing efficiency.

The design improves overall structural integrity while enabling the user to efficiently pack and access such commonly packed items as toiletries, lotions and shampoos.

The system allows such items to be separated from a clothing compartment to reduce the possible spillage damage from such items.

1 Claim, 1 Drawing Sheet

GARMENT BAG CONSTRUCTION INCLUDING REMOVABLE TRIANGULAR CONTAINERS

BACKGROUND AND OBJECTS OF THE INVENTION

The present invention is generally related to the garment bag arts and, in particular, to a system which allows the efficient packing of such bags. The principles described will also be seen to have utility with other containers such as suitcases and briefcases.

Prior art designs, as illustrated by U.S. Pat. Nos. 4,273,223 and 4,693,368 have proven to be costly to make while not providing the space efficiency needed for spillable items such as lotions, shampoos etc.

Prior art designs have also proven to be rather cumbersome to use in practice.

It is also important in the art that a packing system be devised which is easily used by the consumer and readily accessed by the traveler and such persons as airport inspection authorities to reduce unneeded inspection delays.

Accordingly, it is an object of the invention to set forth a novel garment bag packing system which is economical to manufacture and sell and which increases travel packing efficiency by the user.

It is a further object of the invention to demonstrate a packing system wherein such commonly packed items such as liquid lotions and other toiletries are both conveniently packed and accessed by the traveler.

It is a still further object of the present invention to show a packing design with specifically shaped containers which easily fit into an existing garment bag or other similar travel containers.

These and other objects and advantages of the invention will be apparent to those of skill in the travel container arts from the drawings and descriptions included in this specification.

SUMMARY OF THE INVENTION

The invention utilizes specifically shaped containers to fit into the corners of existing garment bags or other similar travel suitcases.

The containers may be triangular in shape for optimal space efficiency within the garment bag itself.

The design provides for ease of access and packing by the consumer while sealing off spillable items such as lotions and toiletries to protect the garments and other items being transported.

DESCRIPTION OF THE DRAWING FIGURES

DESCRIPTION OF THE PREFERRED EMBODIMENT

Figure 1:
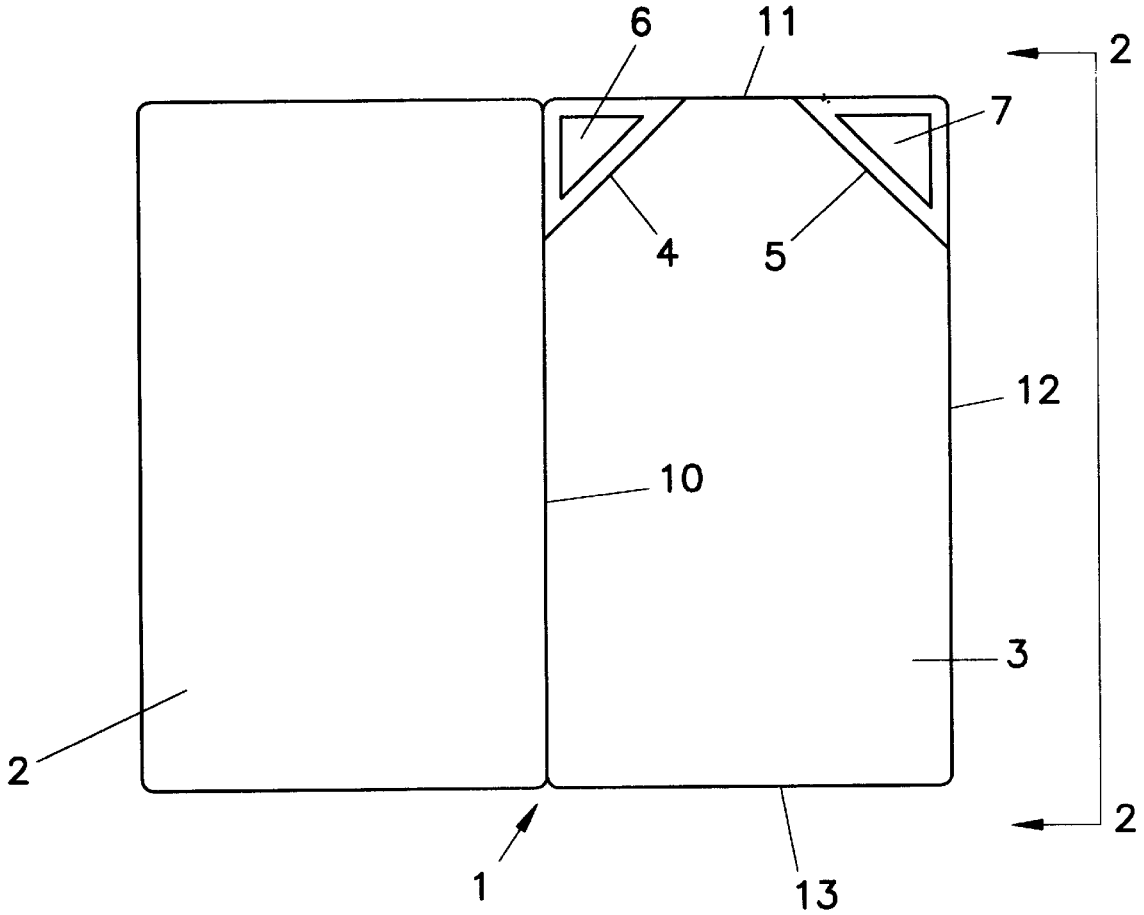
FIG. 1 shows a top view of the container of the present invention in an open position.

Referring to the drawing figures, numeral 1 indicates a travel container such as a garment bag in an open position having a cover 2 and a lower container element 3.

The clothing container 3 has side walls 10, 11, 12 and 13 which may be rigid or flexible depending upon the particular materials utilized.

The upper portions of the container 3 have braces 4 and 5 therein to add stability to the overall unit.

In accord with the invention, smaller containers 6 and 7 are sized so as to be placeable within the brace units 4 and 5.

Figure 2:
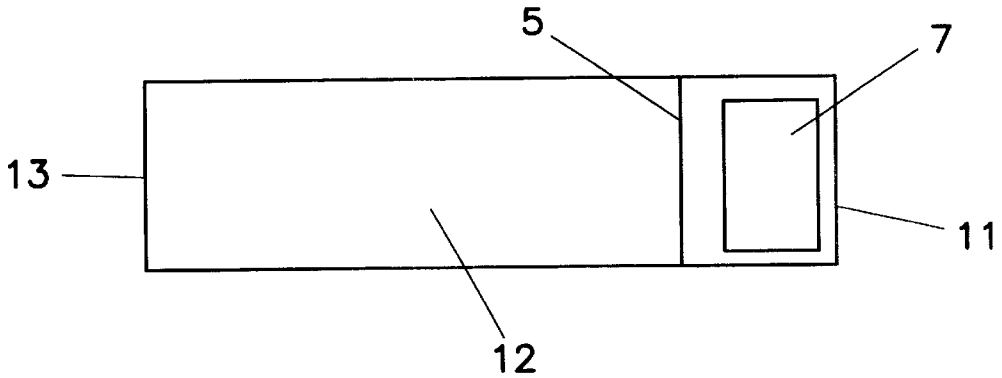
FIG. 2 shows a side view along lines 2—2 of FIG. 1 and illustrates the positioning of a smaller container within the overall structure.

As shown in the side view of FIG. 2, the smaller container, shown as numeral 7, is securely held within the brace element 5 for travel convenience and separation from the central clothing area.

In FIG. 1, the brace elements 4 and 5 are shown as forming triangular compartments for the smaller containers 6 and 7. In practice of the invention, the brace elements may be otherwise shaped depending upon the particular manufacturing requirements. The braces may, for example, be shaped so as to form a rectangular or oval compartment for the smaller container elements.

In practice of the invention, the lower portions of the garment bag may also have brace elements formed therein for containment of third and fourth smaller containers.

While the invention has been described with reference to a garment bag, it will be appreciated that the principles disclosed could be applied to other types of travel carriers such as suitcases or brief cases. The corner brace and container structure described would have packing and structural advantages in such containers as well.

As is known in the art, the container described would have conventional closure elements (not shown) such as zippers or other suitable latching devices.

The materials utilized may comprise fabric, plastic, wood or metal-based compositions depending upon the particular type of container utilized.

It will thus be appreciated that the structure disclosed will provide improved packing efficiency while simultaneously increasing the overall structural integrity of the unit.

The system disclosed also separates such commonly packed items as lotions and shampoos from the clothing compartment.

While a particular embodiment has been shown and described, it is intended herein to cover all equivalent structures and designs.

I claim:

1. A travel container packing system including, a lower container element (3), said lower container element including a first side wall (10), a second side wall (11) adjacent said first side wall, a third side wall (12) adjacent said second side wall, said travel container including a first straight and solid brace element (4) extending directly from said first side wall to said second side wall and a second straight and solid brace element (5) extending directly from said second side wall to said third side wall, a fourth side wall (13) and a cover (2) for closure of the travel container, triangular container means (6,7) for placement within the confines of said solid brace elements, said triangular containers being removable from said travel container and being devoid of fasteners, said triangular containers being sized to fit within the confines of said brace elements, wherein said two solid brace elements form corner, triangular pockets for receipt of said containers.

* * * * *